US005180648A

United States Patent [19]

Nakamura

[11] Patent Number: 5,180,648

[45] Date of Patent: Jan. 19, 1993

[54] PHOTOGRAPHIC PICTURE-TAKING FILM PROCESSING

[75] Inventor: Takashi Nakamura, Minami-ashigara, Japan

[73] Assignee: Fuji Photo Film Co., Ltd., Kanagawa, Japan

[21] Appl. No.: 775,097

[22] Filed: Oct. 11, 1991

[30] Foreign Application Priority Data

Oct. 19, 1990 [JP] Japan ..... 2-281557

[51] Int. Cl.[5] ..... G03C 7/44; G03C 5/31; G03C 5/395

[52] U.S. Cl. ..... 430/21; 430/30; 430/399; 430/400; 430/501; 354/297

[58] Field of Search ..... 430/398, 399, 400, 401, 430/501, 140, 21, 30; 354/297, 298

[56] References Cited

U.S. PATENT DOCUMENTS 4,341,855 7/1982 Morrison et al. ..... 430/140
4,977,067 12/1990 Yoshikawa et al. ..... 430/398

FOREIGN PATENT DOCUMENTS 1-312539 12/1989 Japan ..... 430/501
2083652 3/1982 United Kingdom ..... 354/297

*Primary Examiner*—Charles L. Bowers, Jr.
*Assistant Examiner*—Mark F. Huff
*Attorney, Agent, or Firm*—Sughrue, Mion, Zinn, Macpeak & Seas

[57] ABSTRACT

In processing photographic picture-taking film having picture information born on itself or on a container for the film, the picture information on the film itself or the container is read for determining a processing condition, for example, an amount of processing solution to be replenished on the basis of the read picture information. Then the film is processed under the determined or optimum condition.

7 Claims, 4 Drawing Sheets

PHOTOGRAPHIC PICTURE-TAKING FILM PROCESSING

This invention relates to a method for processing photographic picture-taking films.

BACKGROUND OF THE INVENTION

Photographic silver halide photosensitive material, often simply referred to as photosensitive material hereinafter, after exposure, is processed through a series of steps including color development, desilvering, washing and stabilization in the case of color photosensitive material. There are used color developer for color development, bleaching, blix and fixing solutions for desilvering, city water for washing, and stabilizer for stabilization. Black-and-white photosensitive material is processed through a series of steps including black-and-white development, fixation, and washing. In either case, photosensitive material is generally processed by immersing the photosensitive material in the respective solutions which are normally adjusted to a temperature of 20° to 50° C.

In the commercial practice of such processing of photosensitive material, it is desired to achieve stable and acceptable processing performance with a permissible, minimal amount of processing solution for the purposes of reducing the cost, manual work, pollution loads, and processor size as well as improving the commodity value of processed ones.

The stability of processing performance is obtained by maintaining the processing solution composition within a desired range at all times and the superiority of processing performance is obtained by uniform immersion of the photosensitive material in a sufficient volume of processing solution.

Therefore, as found in color development laboratories, the commercial practice of processing color photosensitive material uses an automatic processor having processing tanks containing large volumes of processing solution. The processor is designed such that whenever a predetermined quantity of color photosensitive material has been processed, a replenisher is automatically fed to the used processing solution for compensating for its exhaustion and maintaining the processing solution within the desired composition range.

In response to the diversification of consumers' interest, consumers' desire to get color prints instantaneously, and the public's interest in the color processing business due to small investments and the like, color photosensitive material processing is in the phase of shifting from conventional centralized processing in big laboratories to diversified small quantity processing in many mini-labs and further to small quantity rapid processing.

Processing steps are discussed next. Steps of processing imagewise exposed film, typically development and bleaching steps, use processing solutions which experience a varying degree of exhaustion since the amount of silver to be developed varies with exposure. In the prior art, the operator determined processing conditions by presuming the degree of exhaustion of the processing solution from the known number of film rolls processed or film length. However, since the amount of silver to be developed varies with exposure conditions which in turn, vary with each of exposed picture frames, the degree of exhaustion of the processing solution varies between different film strips. Therefore, for obtaining good and uniform pictures, it is desirable to determine processing conditions for an individual film strip by considering its exposure conditions.

Particularly, in the case of a mini-lab processor intended for small quantity rapid processing, a limited size of processing tank is filled with a relatively small volume of processing solution which experiences a relatively greater degree of exhaustion per roll film. It is therefore desirable to determine processing conditions for an individual roll of film by taking into account the amount of silver developed which varies with the film being used.

SUMMARY OF THE INVENTION

Therefore, an object of the present invention is to provide a picture-taking film processing method capable of processing a variety of films under conditions optimum for each film, thereby eliminating the drawbacks of the prior art.

In one form of the present invention, a photographic picture-taking film having picture information born on itself or on a container for the film is processed by reading the picture information on the film itself or the container and determining a processing condition on the basis of the read picture information. The film is then processed under the determined condition. Typically, the processing condition is an amount of processing solution to be replenished.

In another form, an apparatus for carrying out the method is provided. A length of exposed film in roll form is contained in a cassette and the film itself or the cassette carries picture information thereon. The apparatus includes a supply means for storing cassettes, a loading means for loading the apparatus with the film by pulling out the film leader from the cassette, a reading means for reading the picture information on the film or cassette, a cutter means for cutting the film at the trailing edge to free the film from the cassette, and a bonding means for bonding the leading edge of the film to the trailing edge of a preceding length of film.

BRIEF DESCRIPTION OF THE DRAWINGS

The above and other objects, features and advantages of the present invention will become apparent by reading the following description taken in conjunction with the accompanying drawings.

DESCRIPTION OF THE PREFERRED EMBODIMENTS

Figure 1:
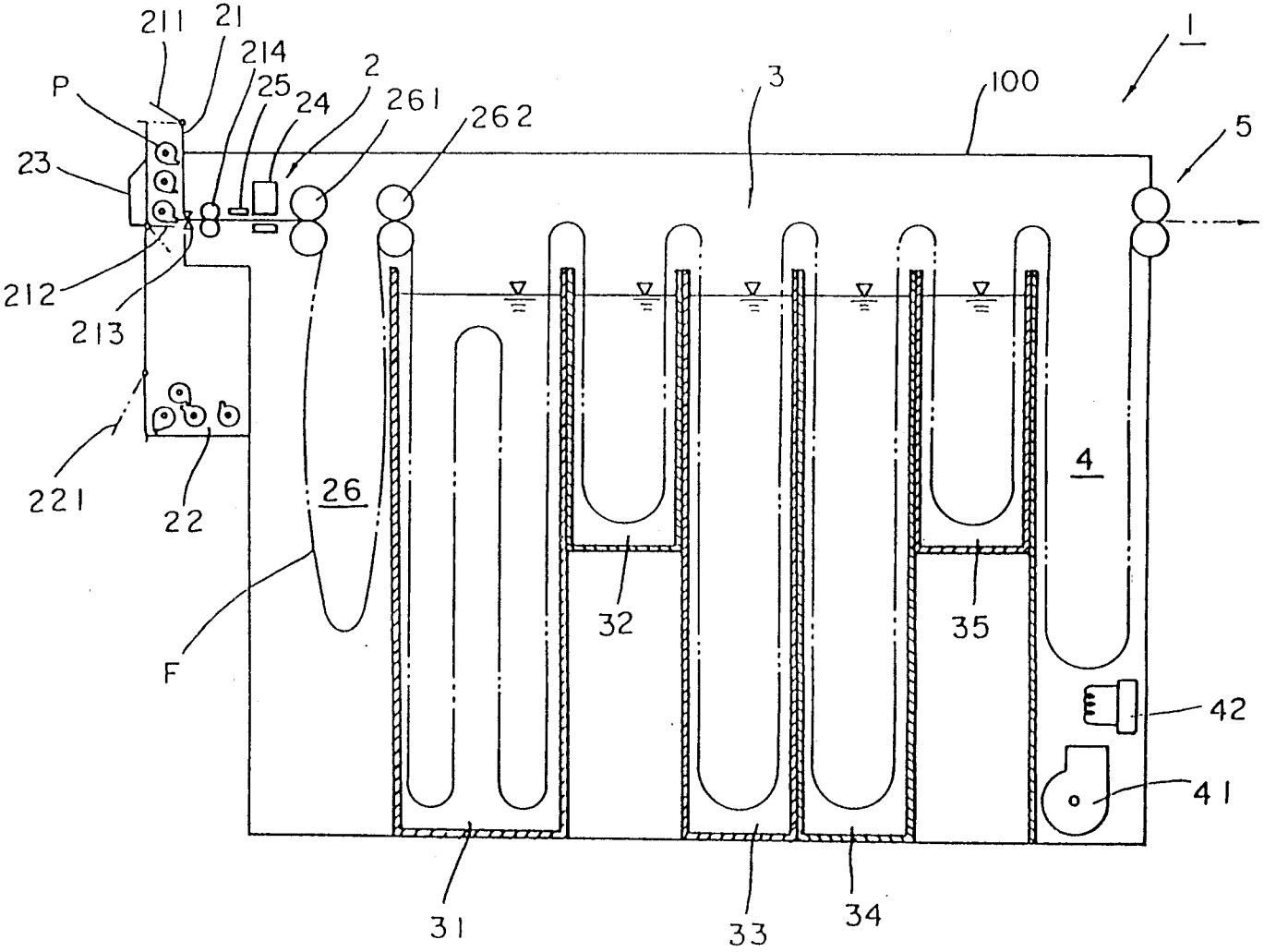
FIG. 1 is a schematic view showing an exemplary arrangement of a photographic picture-taking film processor for practicing the method of the present invention.

Referring to FIG. 1, there is schematically illustrated in side elevation an exemplary arrangement of a photographic picture-taking film processor generally designated at 1 for practicing the method of the present invention.

The processor 1 includes an entry section 2 for receiving strips of exposed photographic film F, a processing section 3 for processing film F, a drying section 4 for drying film F, and an exit section 5 for carrying out film F, all contained in a light shielding casing 100 capable of maintaining light tightness.

The entry section 2 includes a loader or storage 21 for stocking cassettes or cartridges P of roll film in a vertical arrangement and loading the processor with the film. The loader 21 has a cover 211 at the top for sealing the loader against light. The loader 21 near the bottom is provided with lead-in means for locating a cassette P in place, rotating its spool, and pulling out the leader of film F, though not shown in FIG. 1. A cutter 213 is located near a film lead-out of the loader 21 for cutting film F when the entire length of film F has been pulled out of the cassette P. The film F from the cassette P is extended through the lead-out port into the casing interior while it is guided by pairs of rollers 214 and 261.

The loader 21 at the bottom has a discharge shutter 212 which is opened for dropping down the cassette P when it is emptied of film F by the operation of the lead-in means and cutter 213. Located below the loader 21 is a collection chamber 22 for collecting empty cassettes P which are then discharged to the outside by opening a lid 221. Also located near the loader 21 is an operating panel 23 for the processor.

Reading means 25 is disposed in proximity to the film lead-out port of the loader 21 and behind the cutter 213 for reading the picture information born on film F (to be described later). In the case of film F having information recorded in its magnetic layer, the reading means 25 is a magnetic reader having a magnetic head for reading the information in the film magnetic layer.

Located along the travel path of film F and inward of the reading means 25 is bonding means 24 for joining the leader of a newly pulled-out film F to the trailing edge of a previously pulled-out film F into a continuous length of film. The joint may be formed by bonding the film edges with an adhesive tape or by bonding or fusing the film edges with heat or pressure. The bonding means 24 may be an adhesive tape applicator, heat sealer, RF fusion device, stapler, or the like. Of course, the bonding means 24 may be omitted insofar as films F can be successively fed through the processor. With the bonding means 24, films F are continuously fed through the processing section 3 while their leading and trailing edges are connected to the preceding and following films.

As mentioned above, the reading and bonding means 25 and 24 are disposed along the path for film F. Disposed between the bonding means 24 and the processing section 3 is a reservoir 26. The reservoir 26 is defined in the casing 100 and includes a pair of timing rollers 261 adapted to rotate in response to the bonding operation of the bonding means 24 and a pair of normally rotating feed rollers 262 disposed at the entrance port of a developing tank 31. As shown in FIG. 1, film F being fed sags between the timing and feed rollers 261 and 262. The reservoir 26 plays the buffer role, that is, the role of adjusting the difference between the feed rate of film F being extended out of the cassette P and the feed rate of film F passing through the processing section 3.

The processing section 3 includes a plurality of processing tanks. Arranged in the processing section 3 from the entry section 2 side are a developing tank 31, a bleaching tank 32, a fixing tank 33, a washing tank 34, and a stabilizing tank 35, which are filled with respective processing solutions. Disposed in the respective tanks and between the adjacent tanks are feed means for feeding film F forward including rollers and guides (not shown). The film F is fed along a serpentine path depicted by a phantom line in FIG. 1 so that it is successively dipped in and processed with the processing solutions int he developing, bleaching, fixing, washing and stabilizing tanks 31, 32, 33, 34, and 35. The distribution and arrangement of tanks in the processing section 3 are not limited to the illustrated ones.

Figure 3:
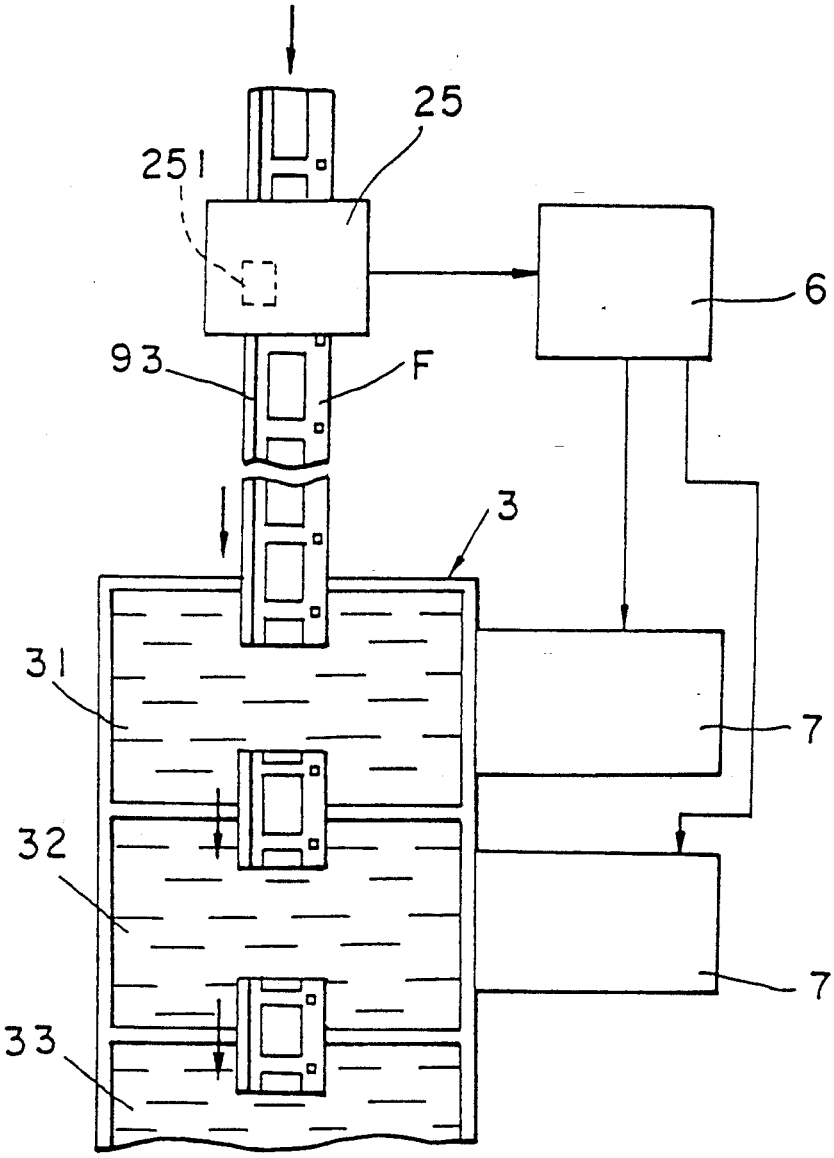
FIG. 3 is a plane view showing reading means relative to the film and a block diagram showing a control system including the reading means, control unit, and replenishing means.

The processor 1 includes a replenishment system for making up a fresh replenisher to each processing solution when necessary, while allowing the exhausted solution exits the tank in an overflow manner, thereby maintaining the processing solution in the tank at an effective composition range. As shown in FIG. 3, each of the processing tanks is provided with replenishing means 7 including a reservoir tank containing a replenisher which is channeled to the processing tank associated therewith. The replenishing means 7 is controlled by a control unit 6 to be described later whereby a controlled amount of replenisher is channeled to the tank when required.

As shown in FIG. 1, the processing section 3 on the exit side is followed by the drying section 4. The drying section 4 serves to dry the as-processed film F in wet condition by blowing warm air at about 30° to 70° C. To this end, a blower 41 and a heater 42 are arranged in the drying section 4 for blowing warm air toward film F.

Now, the film F to be processed through the processor as mentioned above is described.

The film F should carry the information about exposure conditions upon picture taking, for example, in the form of magnetic or optical signals. One exemplary film is shown in FIG. 2.

Figure 2:
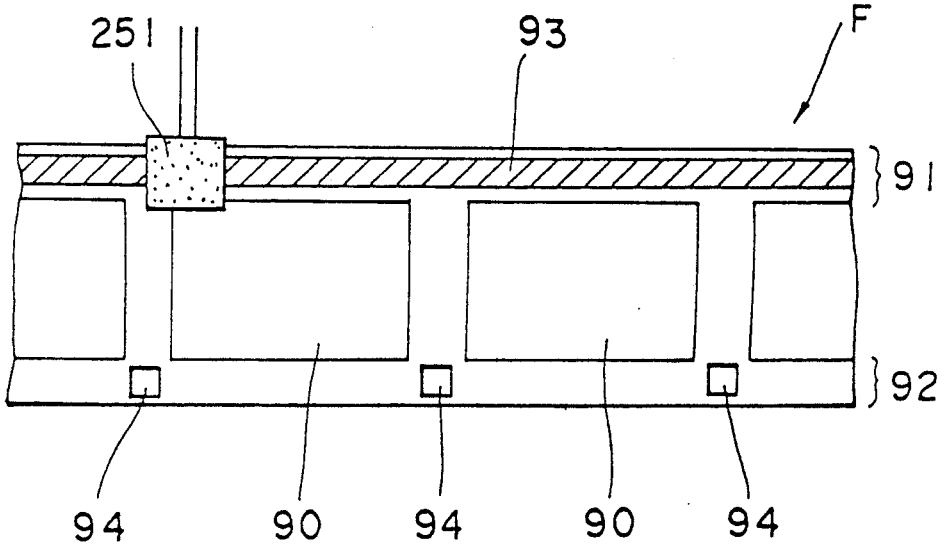
FIG. 2 is a fragmentary plan view of a film to be processed.

As shown in FIG. 2, film F is a length of strip including a series of rectangular frames or image areas 90 created by picture taking or exposure and a pair of lateral bands 91 and 92 defined transversely outward of the frames 90 and longitudinally extending along the opposite edges of the length of strip. The lateral band 91 is mainly used as an information recording or carrying site and often a magnetic recording portion in the form of a magnetic layer is formed. That is, the lateral band 91 on the front (emulsion side) or rear surface of film F is provided with a magnetic recording track 93 (shaded in FIG. 2). Bits of information relating to the exposure conditions during picture taking are recorded in the magnetic recording track 93 typically within the camera, preferably frame by frame.

The reading means 25 includes a magnetic head 251 located along the film path in alignment with the magnetic recording track 93. The film F is longitudinally passed across the head 251 so that the magnetic recording track 93 comes in contact with the head 251 whereby the head 251 reads the information in the track 93 to produce electrical signals.

The other lateral band 92 is provided with perforations 94 for feeding and indexing the film within the camera. Preferably the film contains up to 4 perforations, more preferably up to 2 perforations, most preferably 1 or ½ perforation per frame as shown in FIG. 2. It is to be noted that ½ perforation per frame means that the normal frame 90 shown in FIG. 2 is divided into half-size frames. The provision of up to 4 perforations per frame along only one lateral band 92 ensures that an extra area is available for forming the information carrying portion such as the magnetic recording track 93.

The information to be recorded in the magnetic recording track 93 includes the amount of over or under exposure of each exposed frame 90, especially with respect to the sensitivity of the film. More particularly, the information includes the prescribed data of the film including the sensitivity and type (for example, generally or professional, make, etc.) thereof, and the data of actual shooting of each frame including shutter speed, stop, LV (light value without strobe flashing), rear light, strobe flashing, light quantity of flashed strobe, and strobe-to-object distance. A selected one or more of such data can be utilized.

In addition to the above-mentioned information relating to film and its exposure, the magnetic recording track 93 may carry additional bits of information, for example, shooting data such as color temperature, object distance, lens focal length, object contrast, and shooting date, time, and place, film data such as the manufacturer, type and manufacturing date of film, and laboratory data such as developing conditions.

The film data may be borne on film at one or more sites, often at one site, for example, at the leading or trailing edge of the film.

Understandably, the construction of film is not limited to that shown in FIG. 2. For example, instead of the magnetic recording track 93, the information recording portion may be embodied by forming a transparent magnetic layer on the rear surface of film where the information can be recorded.

Various types of film can be processed according to the present invention, including color reversal film, color negative film, and black-and-white negative film, and if desired, micro film and direct radiographic paper. Either a length of film or a sheet of film is acceptable. The invention is advantageous when applied to a length of film because the exposure condition of each frame can be detected. The film may be of any desired size although it is most often of 35 mm wide.

Also contemplated herein is to magnetically or electrically record the information of film on a cassette P which is a container for the film. In this case, the cassette P is provided with a magnetic recording track as mentioned above or an IC memory where the information is recorded or stored. In the embodiment where the cassette P has information born thereon, the arrangement of FIG. 1 should be modified such that the reading means 25 is located in the loader 21 so as to face the cassette P near the lead-out port.

Referring to FIG. 3, the control system includes in electrical connection the reading means 25, a control unit 6 and replenishment means 7 associated with the developing and bleaching tanks 31 and 32. Signals indicative of the information read by the reading means 25 are delivered to the control unit 6 which is located within the operating panel 23, in FIG. 1, for example. If desired, the data of a bar code on the film F and/or the data of a DX code on the cassette may also be input to the control unit 6.

The control unit 6 selects necessary data from the input data, performs predetermined arithmetic operation of the data, thereby determining the amounts of processing solutions to be replenished to the developing and bleaching tanks 31 and 32.

Figure 4:
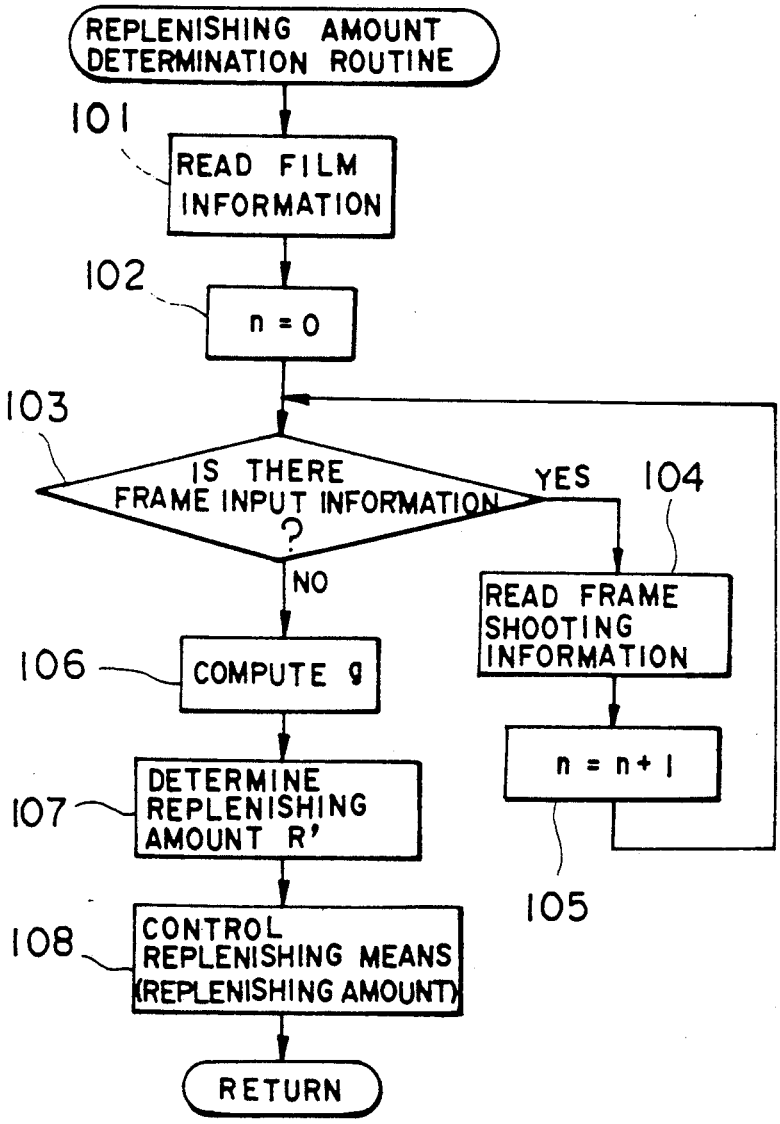
FIG. 4 is a flow chart showing algorithms for determining processing solution replenishment.

Referring to FIG. 4, the algorithm taken by the control unit 6 is now described. FIG. 4 is an operational flow chart of the control unit 6.

Assume that a length of exposed film F enters the processor. Step 101 is to read the data recorded at the leader of film F. Step 102 is to initialize the n memory for inputting the number of exposed frames 90, that is, to input 0. Step 103 is to judge whether or not the incoming film F has the shooting data of each frame 90 recorded in the magnetic recording track 93. If film F has the shooting data, the data is read in step 104, the number of frames is counted in step 105, and the algorithm returns to step 103. In this way, the shooting data of every frame 90 are read in steps 103 to 105.

If step 103 finds that the films has no further frame input data, the algorithm proceeds to step 106 for extracting necessary data from all the read information data and computing a coefficient of correction g on the basis of the necessary data in a manner as will be described later. Step 107 is to determine, on the basis of the computed results, the amounts R′ of processing solutions to be replenished to the developing and bleaching tanks 31 and 32. Next step 108 is to actuate the replenishing means 7 in a controlled manner so that the replenishing means 7 may feed the metered amounts of replenishers.

In this way, control operation is taken for each film F whereby an optimum amount of replenisher solution is made up for each film. In the case of an IC memory having information data stored therein, the data can be read instantaneously, resulting in an increased processing rate since steps 102, 103, 104, and 105 can be eliminated.

The computation algorithm of step 106 is described. This computation utilizes data selected from the film data including sensitivity, number of available frames (e.g. 24 or 36 frames), and number of exposed frames, and the actual shooting data including shutter speed, stop, LV (light value without strobe flashing), rear light, strobe flashing, light quantity of flashed strobe, and strobe-object distance.

Assuming an ideal film having all the frames 90 thereof exposed under a rear light-free condition with optimum exposure quantity relative to the film sensitivity without flashing a strobe (the exposed film contains no blank frame), the computation algorithm determines the amount of processing solution to be replenished for processing the ideal film as a standard replenishment amount Ro. Further coefficients of correction are predetermined provided that the standard replenishment amount Ro is unity (1). The coefficients of correction are multiplied for every frame of film to be processed and averaged to provide a coefficient of correction g for the film. Then the replenishment amount R′ for the film is determined by the following equation.

$$R' = Ro \times g$$

More precisely, g is determined by equation (1).

$$g = a \times \sum_{j=1}^{n} (bj \times cj \times dj)/n \qquad (1)$$

In equation (1), a is a coefficient of correction for blank frames, a=n/N wherein n is the number of exposed frames and N is the number of available frames.

Letter b is a coefficient of exposure correction. A set of shutter speed and stop giving an optimum exposure to a particular film is determinable from the sensitivity and LV of the film. If an actual exposure is over or under the optimum exposure, the coefficient of exposure correction b is determined in accordance with a coefficient of exposure m as shown in Table 1.

It is to be noted that the coefficient of exposure m is defined as $$m = [\log(E/S)]/\log 2$$

wherein S is a film sensitivity in ASA and E is an exposure of an exposed frame in lux × sec.

Letter c is a coefficient of strobe correction. When a strobe is flashed, there is the general tendency that when E ≧ S, the exposure of a front object or person is increased and the amount of silver developed is increased about 10% and when E ≦ S, the exposure of the front object or person is greater than the average exposure of the entire frame, but the surrounding is less exposed and as a consequence, the amount of silver developed is decreased about 10% to 20%. Therefore, whether or not the strobe is flashed constitutes a coefficient of correction. It is determined as shown in Table 1.

Letter d is a coefficient of rear light correction. In the case of shooting under a rear light condition, there is the general tendency opposite to the tendency occurring with strobe flashing. Therefore, whether or not rear light is present constitutes a coefficient of correction. It is determined in an inverse relationship to the coefficient of strobe correction c as shown in Table 1.

TABLE 1

| | | | | | | c. flash | | d. rear light | |
|---|---|---|---|---|---|---|---|---|---|
| S | E | E/S | log(E/S) | m | b | Yes | No | Yes | No |
| 100 | 1600 | 16 | 4log2 | +4 | 1.6 | 1.10 | 1 | 1.20 | 1 |
| 100 | 800 | 8 | 3log2 | +3 | 1.45 | 1.10 | 1 | 1.20 | 1 |
| 100 | 400 | 4 | 2log2 | +2 | 1.3 | 1.10 | 1 | 1.20 | 1 |
| 100 | 200 | 2 | 1log2 | +1 | 1.15 | 1.10 | 1 | 1.10 | 1 |
| 100 | 100 | 1.0 | 0 | 0 (optimum) | 1 | 1 | 1 | 1 | 1 |
| 100 | 50 | 0.5 | −1log2 | −1 | 0.85 | 0.9 | 1 | 0.9 | 1 |
| 100 | 25 | 0.25 | −2log2 | −2 | 0.70 | 0.8 | 1 | 0.9 | 1 |
| 100 | 12.5 | 0.125 | −3log2 | −3 | 0.55 | 0.8 | 1 | 0.9 | 1 |
| 100 | 6.25 | 0.0625 | −4log2 | −4 | 0.40 | 0.8 | 1 | 0.9 | 1 |

m = [log(E/S)]/log2

In accordance with the aformentioned algorithm, the amounts R′ of processing solutions to be replenished are determined. Then the replenishing means 7 are controlledly operated in accordance with the determined amounts, supplying optimum amounts of processing solutions to the associated tanks.

It is to be noted that although the coefficient of exposure correction b is determined using the coefficient of exposure m as a parameter, the exposure E may be used as a parameter if the film sensitivity is fixed. In this case, if one of stop and shutter speed is fixed, the other may be used as a parameter.

In the above embodiment, the algorithm uses all the coefficients of correction a, b, c and d although computation can be made using one or two or three of these coefficients. In formula (1), any one, two or three of the four coefficients of correction a and all bj, cj, and dj are assumed to be unity, and the remaining three, two or one coefficient is used in computation to determine g. It is preferred, however, that two to four coefficients are used in computation while the remaining two, one or zero coefficient is assumed to be unity. Most often, the coefficient of blank frame correction a is always used in computation since the number of blank frames has the greatest influence on the exhaustion of processing solution.

In the embodiment illustrated herein, the amount of processing solution to be replenished is controlled to provide an optimum processing condition, but instead to additionally, another factor or factors such as the feed rate or processing time of film and the temperature and concentration of processing solution may be controlled to provide an optimum processing condition.

Although the control of the amounts of developing and bleaching solutions replenished has been described, the arrangement may expanded so as to additionally control the amounts of fixer, washing water, and stabilizer replenished. In the case of color film processing, it is effective to control the amounts of developing, bleaching and blix solutions to be replenished in order that the developed silver by appropriately bleached.

The processing tanks as typified by the developing tank 31 may be ones having a narrow processing path as disclosed in Japanese Patent Application Nos. 89052/1987, 131138/1988, 216050/1988, 26855/1989, and 130548/1989 because the advantages including reduced processing solution replenishing amount, reduced waste solution amount, improved processing efficiency, reduced size of processor are achieved. Additionally, the control of the amount of processing solution replenished according to the invention become more effective since the amount of processing solution replenished to each tank is very small.

Although the method of the present invention has been described with respect the development of color negative film, the invention is not limited thereto. The invention is also applicable to various photographic picture-taking photosensitive materials such as color reversal film, black-and-white negative film, micro film, and direct radiographic paper. All these photosensitive materials are herein designated photographic picture-taking films.

The photosensitive material, processing solution composition, processing procedure may be conventional and are described in the literature and patents including those referred herein.

There has been described a method for processing photographic picture-taking films which can achieve consistent uniform processing of different films and maintain stable processing having tanks of small volume.

Although some preferred embodiments have been described, many modifications and variations may be made thereto in the light of the above teachings. It is therefore to be understood that within the scope of the appended claims, the invention may be practiced otherwise than as specifically described.

What is claimed is:

1. A method for processing a photographic picture-taking film having picture information born on itself or on a container for the film, comprising the steps of:

reading the picture information on the film itself or the container, determining a processing condition on the basis of the read picture information, and processing the film under the determined condition, wherein the processing condition is an amount of processing solution to be replenished.

2. The method of claim 1 wherein the film contains up to 4 perforations per frame along one or both lateral edges thereof.

3. The method of claim 1 wherein the picture information is selected from the group consisting of shutter speed, stop, light value, rear light, strobe flashing, light quantity of flashed strobe, strobe-to-object distance, and the number of exposed frames.

4. The method of claim 1 wherein the step of determining a processing condition on the basis of the picture information includes the steps of predetermining a standard replenishing amount Ro, determining a coefficient of correction g from the picture information, and obtaining an actual replenishing amount R' according to the equation: $R' = Ro \times g$, wherein said coefficient of correction g is obtained from the equation:

$$g = a \times \sum_{j=1}^{n} (bj \times cj \times dj)/n$$

wherein a is a coefficient of correction for blank frames, that is, $a = n/N$ wherein n is the number of exposed frames and N is the number of available frames, b is a coefficient of exposure correction, c is a coefficient of strobe flashing correction, and d is a coefficient of rear light correction.

5. The method of claim 1 wherein the film on a surface has a longitudinally extending magnetic recording track for recording the picture information.

6. The method of claim 1 wherein the film or the container carries film information thereon, said method further comprises the steps of:

reading the film information on the film or the container, and determining a processing condition using both the picture information and the film information.

7. The method of claim 6 wherein said film information is selected from the group consisting of film sensitivity and the number of available frames.

* * * * *